US006330982B1

(12) United States Patent
Yu et al.

(10) Patent No.: US 6,330,982 B1
(45) Date of Patent: Dec. 18, 2001

(54) HAMMER MILL

(76) Inventors: Xin Guo Yu; Qi Cheng Le, both of 1408 Room No. 9, YanJi Six Village, Shanghai (CN), 200093

( * ) Notice: Subject to any disclaimer, the term of this patent is extended or adjusted under 35 U.S.C. 154(b) by 0 days.

(21) Appl. No.: 09/308,021

(22) PCT Filed: Nov. 14, 1997

(86) PCT No.: PCT/CN97/00130

§ 371 Date: May 12, 1999

§ 102(e) Date: May 12, 1999

(87) PCT Pub. No.: WO98/20977

PCT Pub. Date: May 22, 1998

(30) Foreign Application Priority Data

Nov. 14, 1996 (CN) ..... 96116579

(51) Int. Cl.[7] ..... B02C 13/286

(52) U.S. Cl. ..... 241/73; 241/189.1

(58) Field of Search ..... 241/73, 74, 194, 241/195, 189.1

(56) References Cited

U.S. PATENT DOCUMENTS

| | | | | |
|---|---|---|---|---|
| 3,790,093 | | 2/1974 | McIntyre . | |
| 4,114,817 | | 9/1978 | Harris . | |
| 5,199,666 | * | 4/1993 | Williams | 241/73 |
| 5,749,471 | * | 5/1998 | Andersson . | |

FOREIGN PATENT DOCUMENTS

| | | |
|---|---|---|
| 2156931 | 2/1994 | (CN) . |
| 2186604 | 1/1995 | (CN) . |
| 2203184 | 7/1995 | (CN) . |
| 2214225 | 12/1995 | (CN) . |
| WO 94/26415 | 11/1994 | (WO) . |

OTHER PUBLICATIONS

"Preliminary Report on the Effect of Scaled Screen Plate", Shanghai Feed Magazine, Jan. 1994, China.
"Application on Improved Process of Model 91940–40 Economic Feed Hammer Mill", China Feed Magazine, Issue 1, 1995.
"Application on Improved Process of Vertical Roter Hammer Mill", China Feed, Issue 1, 1991.
"Design Improvement and Study on the Aspirating System of Hammer Mills—Non–aspirating Vertical Rotor Hammer Mill", China Feed, Issue 17, 1995.
Chinese Feed, 1993, issue 12, "Grinding Problems of Shrimp Feeds".
"Air–flow Sizing of Feed Particles".
Hammer Mill, 1989, p. 393, "Basic Knowledge of Feed Industry".
Schutte Industrial Hammer Mills, Series 301, Model 38.
Chamion Grinder (CPM), CPM, California Pellet Mill Co.
"Main Technology Parameter of Common Hammer Mills 1, 2, 3, 4", pp. 400–404.
Feed Machinery, 1981, p. 45, Buhler Brothers Ltd Buhler–Miag Ltd, "New Foreign Large–Power Hammer Mills".
Patented product ZL 94309438.0.
Chinese grain and Feed Industry, p. 21, 1996, "Grinder Quality Grade Table".

(List continued on next page.)

*Primary Examiner*—York Rosenbaum
(74) *Attorney, Agent, or Firm*—Merchant & Gould P.C.

(57) ABSTRACT

This invention relates to a hammer mill used for feed processing, food processing or chemical industries. The said hammer mill has a casing, a rotor arranged in the casing and is provided with several hammers, and a vibrating screen with an active power source located around the rotor. The vibrating parameters can be set for control. In the cross section of the rotor, the width of the screen in the horizontal direction is more than that in the vertical height and it is symmetrical at the left and the right.

7 Claims, 4 Drawing Sheets

OTHER PUBLICATIONS

Feed Standards Compilation Manual, p. 435, p. 439, 1992, "Hammer Mill Hammers".
China Feed, vol. 16, No. 2, 1995, pp. 27–29.
Vertica grinder produced by China Beijing Buhler Co., Ltd. "Hammer Screen Clearance", p. 399.
Summary Report of American Technology Observation, p. 112.
Feed Manufacturing Technology, 1985, p. 131.
Feed Industry, p. 14, 1994, vol. 15, No. 3, "How to control the product size of hammer mills".
Feed Manufacturing Technology, Robert R. McEllhiney, 1996, pp. 127–128.
Basic Knowledge on Feed Industry, "Standardized Hammer Sizes," 1989, p. 395.
Basic Knowledge on Feed Industry, Chapter 2, 1989, p. 393.

* cited by examiner

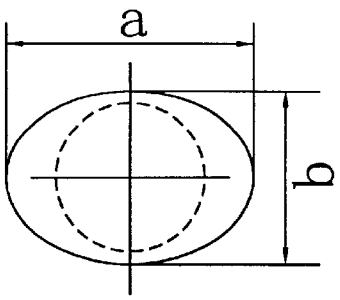
Fig 3
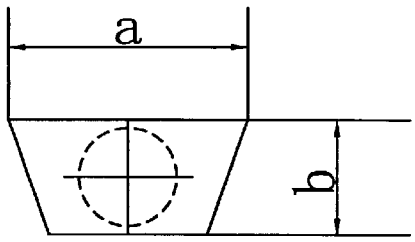
Fig 4
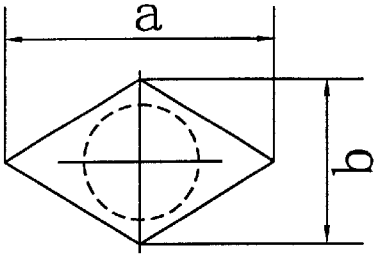
Fig 5
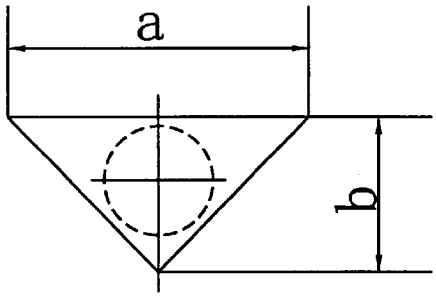
Fig 6
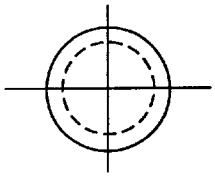
FIG. 7A
FIG. 7B
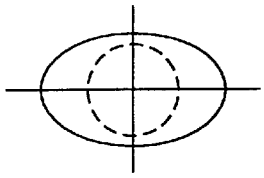
FIG. 7C
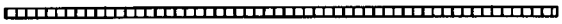
FIG. 7D
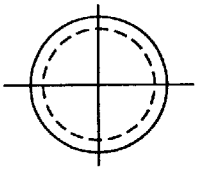
FIG. 8A
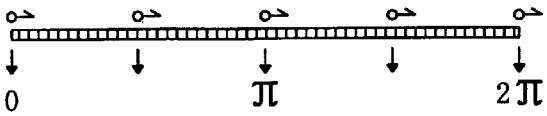
FIG. 8B

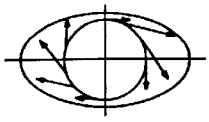
FIG. 9A
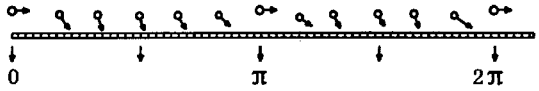
FIG. 9B
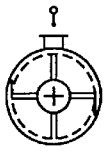
FIG. 10A
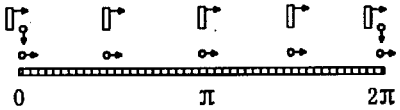
FIG. 10B
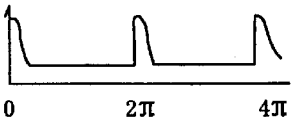
FIG. 10C
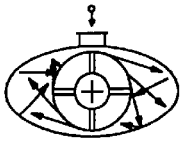
FIG. 11A
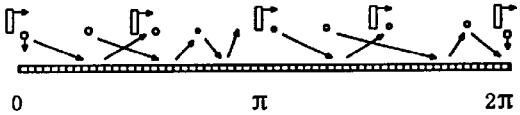
FIG. 11B
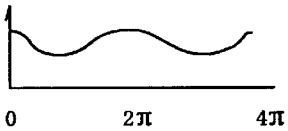
FIG. 11C
FIG. 12A
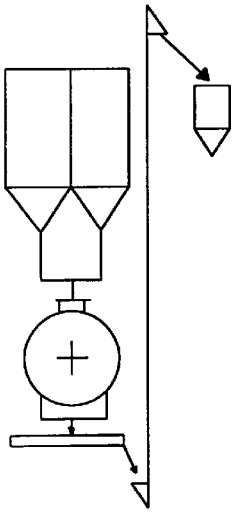
FIG. 12B
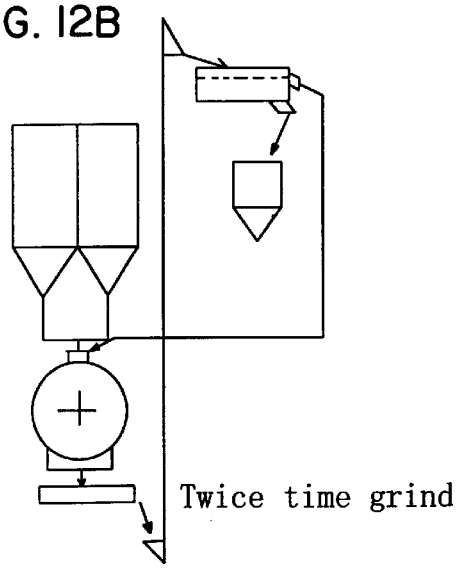

HAMMER MILL

TECHNOLOGY FIELD

This invention relates to a type of hammer mill, especially a rotary hammer mill generally used in the areas of feed processing, food processing and chemical industries.

BACKGROUND TECHNOLOGY

Nowadays, a variety of recognized existing types of mills generally include screens, hammers, rotors, machine body and motors. During operation, the motor drives the rotors, on which the hammers are rotating and crushing the material so that acceptable sizes of pulverized particles are discharged from the screen sieve.

Such hammer mills usually have the deficiency as described below:

1. They only produce coarse material (e.g., poultry feed with screen sieves of 1, 2, 3 and 4 mm in diameters) and are incapable of producing fine material (e.g., aquatic feed with screen sieves of 40, 50, 60, 70, 80, 90, 100, 120, and 140 meshes, or more.)

2. They may cause the finished material to be uneven in particle size.

3. These types of hammer mills are inefficient.

The major reasons for inefficiency include:

A. The screening and crushing capability of the hammer mills is relatively inadequate so pulverized particles will not be discharged promptly and may cause repeated cycling of the material for processing to the acceptable sizes, with a result that the fine particle ratio is increased, uneven sizes of finished material are produced and the power consumption is more.

B. Generally, the blades of the screened hammer mill have dual functions of crushing and serving as a power source to discharge the particles through the screen sieves. The hammer blades, as the sole power source in the screening process, may be blocked by multi-layers of the material cycling near the surface, thereby limiting the push and extruding forces that are applied to the material through the screen. For coarse material with greater sizes and less layers of material cycling required, the acting forces of the hammer blades are effected on the surface of the screen, resulting in smooth discharge of the pulverized particles of the feed material whereas for the fine material, the diameters are far smaller than the clearance between the screen and the hammer and more material cycling is required, it is more difficult for the acting force of the hammer blades to reach the surfaces of the screen, thus retaining the material on the screen surface, such retention state of the material may cause blockage of the finished material. Hence such screened hammer mills are not able to process fine particles of the material with 40 to 140 meshes.

Previous improvement mades always focused the improvement on the physical factors such as screen shape design, screen construction, clearance between the hammer and the screen, aspirating system and the hammer configuration and so on, without considering the active power source with the screen and studing further. Several examples of the previous improvement are given below:

a. Improvement on shapes of the screen sieves—such as fish scaled sieves type of screens (refer to the article "Preliminary Report on the Effect of Scaled Screen Plate" as published on "Shanghai Feed" magazine Jan. 1994 in China.).

b. Improvement on extended screen surfaces—such as axially fed widening screen type of the hammer mill (refer to the article "Application on Improved Process of Model 91940-40 Economic Feed Hammer Mill" as published on "China Feed" magazine, Issue 1, 1995); and also the type of the hammer mill is shown in FIG. 4 of U.S. Pat. No. 4,114,817 (Harris) (Sep. 19, 1978) with such a feature that the surface area of the screen is increased by extending the axially screen width.

c. Further improvements are by having an increasingly rounded screen comer, increasing of screen surface and mounting method, such as vertical rotor type hammer mill with no aspiration installation (refer to the article "Application on Improved Process of Vertical Rotor Hammer Mill" as published on "China Feed" Issue 1, 1991; various axially feed designs of hammer mills; dipping type hammer mills; and also a type of hammer mill disclosed in FIG. 2 of U.S. Pat. No. 3,790,093 (Mcintyre) (May 2, 1974) has a screen development on the left side, which increases the surface areas, but the screen is considered liable to be blocked by larger size material at a section of the left side, thus failing to achieve the anticipated result. Moreover, this improvement is an eccentric feed design which fails to make full use of the forward and reverse rotation of the hammer, resulting in non-uniform wear of the hammers and the screen.

d. Improvement on aspirating system of the hammer—refer to the article "Design Improvement and Study on the Aspirating System of Hammer Mills—Non-aspirating Vertical Rotor Hammer Mill" as published on "China Feed" Issue 17, 1995.

e. Improvement on mounting with roll chain end-connected spring and hammer mill aspirating system with holes at the axial wall and air blow blades patented in China, China Patent No. CN 2156931 (Li Dayan) (Feb. 23, 1994) describes a type of vibrating screen. However, it is not a vibrating screen with an active power source, but the vibration is induced by material impacting screen surfaces with no control of vibrating parameters.

f. Improvement on clearance between the hammer and the screen—the improved clearance between the hammer and the screen of the mill is adjustable (in two steps), which is capable of processing the feed material with feed sizes of 0.8 to 4.0 mm in diameters. This improvement of hammer mill has extended the range of the material to be processed as compared to conventional mills, but is not applicable for the sizes of 60 to 140 meshes fine material.

In short, lots of improvements have been made on the hammer mills and have achieved certain results, yet no hammer mills in the world by then are capable of processing both coarse material (sieves 1 to 4 mm in diameters) and fine material sizes (40 to 140 meshes).

Abundant experiments have indicated that the improvement made on the active power source to the screen and proper selection of mounting of the special vibrating source and the vibrating parameters, e.g., vibrating direction, frequency, amplitude, etc., are the keys to solve the material blockage problems so that the screen will be no more solely effected by the acting force of the hammer blades, but rely on its independent discharging capability, which will have enough capability for screening the fine material particles.

SUMMARY OF THE INVENTION

The invention provides a screened hammer mill that is capable of processing both coarse pulverized particles (screen sieves 1 to 4 mm in diameters) and fine pulverized particles sizes (40 to 140 meshes) and also produces relatively even sizes of the material with higher efficiency.

The invention pinpoints a major design improvement given below based on the existing technical deficiency mentioned in the above paragraphs. The improvement of this invention is described as follows:

1. A hammer mill screen is enhanced with an additionally independent source for vibrating. The said vibrating source is attached to the screen, which includes the functions of motor, etc. The improved mounting is to install the vibrator at the center of the gravity of the screen apart from the machine body and the other reaction force of the vibrating source is suspended (free) so that no effect is made to the machine body by the vibrating energy produced in the processing. The vibrational direction of the screen of the rotor is upward and downward as well as leftward and rightward on the radial plane relative to the rotor with vibrating frequency and amplitude controllable.

Generally speaking, the screen and machine body of the conventional hammer mills may produce resonance and residual vibration when the motor is operating and screen vibration may be caused when the material is impacting the screen surfaces, yet hardly results in desired effect as it is essentially an inactive and passive vibration, of which the vibrating parameters are not able to be controlled. With an additional vibrating source, the passive vibration is turned out to be active vibration. This critical change, i.e., resonance generation, may only occur with the screen to discharge the material when vibration reaches certain degree of energy and is controlled. Hence this change from the sliding screen of conventional hammer mills to the vibrating screen requires an appropriate amplitude, which will create an uninterrupted varying state of the clearance between the hammer and the screen to make the vibrating screen to adapt better various sizes of the material so that the fine material of 40 to 140 meshes are discharged properly and even particle sizes of coarse material are improved.

2. The screen is designed to be horizontally (laterally) extended in width which features that the maximum lateral from the left to the right of the frame against the contour of the rotor side is 1.2 to 4 times of the maximum size of the vertical height, while the laterally extended screen is composed of the screen plates, both side plates and the screen frame around the radial plane of the rotor of the hammer mill. It means the lateral width is higher than the vertical height of the screen and it is symmetrical at the left and the right.

The term "around the radial plane of the rotor of the hammer mill" has defined a comparative range, which means axially lateral width is not limited, the definition of the term lateral width design actually implies multi-shapes design as any elliptical, oval, trapezoidal, rhomboidal, triangular and any non-standard approximate irregular shapes arranged laterally, also excludes the round shape, which is equal in both width and height and the dipping type of hammer mill, of which the vertical height is more than the width. In a word, the design concept of laterally width extension is the key point, which has avoided many insignificant factors. The selection of "1.2 to 4 times" has excluded the factors of manufacturing tolerance error, size variation of the addendum and root of the toothed plates and also various eccentric factors including the unequal clearance between the screen and hammer usually occurred in the eccentric design. In addition, the coefficient of lower limit "1.2 times" is defined to not only avoid from the existing design, but also generate the anticipated effect of this invention. And "4 times" defined as upper limit is adequate. It will have the same effect if more than 4 is taken, but senseless.

The simple lateral width design has the functions of extending screen surfaces, break material cycling and improve the angles for discharging, but liable blockage of screen sieves may occur where the clearance between the hammer and the screen is greater and the extended surface of this design fails to be brought into full display. That is why the general comment of the feed industry considered such screen shape design is invalid. However, this improvement with addition of an active power source for vibrating has given new life to such a design that the previous deficiency of laterally width design has been overcome and this invention has developed its advantage to the full display. Meanwhile, new lateral width design is provided with certain space for amplitude so that the screen surface is able to generate greater vibrational amplitude (more than 20 mm) relative to the rotor around the radial plane of the rotor.

It can be seen from the above, lateral width extension and vibration are two elements of being dependent with each other and new features arising therefrom are created. With neither of the two factors, the three purposes mentioned in the foregoing paragraphs could be achieved.

To obtain the above purposes, this invention intends to incorporate the screen, hammer blades, the rotor, machine body and the motor etc. in the hammer mill and make improvement on the screen assembly. The said screen of this invention is of symmetrical axis and lateral extended width screen design with an active vibrating power source.

BRIEF DESCRIPTION OF THE DRAWINGS

FIG. 3 shows a schematic diagram of the laterally oval screen design of the hammer mill (The outer lines indicate the frame of the screen and the inner dotted lines indicate the end traces of the hammer blade. The notes are same, applicable for the other diagrams given below);

FIG. 4 shows schematic diagrams of the laterally trapezoidal screen design of the hammer mill;

FIG. 5 shows schematic diagrams of the laterally rhomboidal screen design of the hammer mill;

FIG. 6 shows schematic diagrams of the laterally triangular screen design of the hammer mill;

FIGS. 7*a*, 7*b*, 7*c* and 7*d* show respectively the schematic diagrams and the developed views of the round-shaped and elliptical screen designs of the hammer mill;

FIGS. 8*a* and 8*b* show respectively the schematic diagrams and directional indication of material flow and discharge of round-shaped screen designs of the hammer mill;

FIGS. 9*a* and 9*b* show respectively the schematic diagrams and directional indication of material flow and discharge of elliptical screen design of the hammer mill;

FIGS. 10*a*, 10*b* and 10*c* show respectively the schematic diagrams of material flow direction, hammer blade process flow and crushing efficiency of round-shaped screen design of the hammer mill;

FIGS. 11*a*, 11*b* and 11*c* show respectively the schematic diagrams of material flow direction, hammer blade process flow and crushing efficiency of sub-elliptical screen design of the hammer mill; and FIGS. 12*a* and 12*b* show respectively the process flow diagrams for 1-stage and 2-stage crushing of the hammer mill.

THE PREFERRED EMBODIMENT OF THE PRESENT INVENTION

Figure 1:
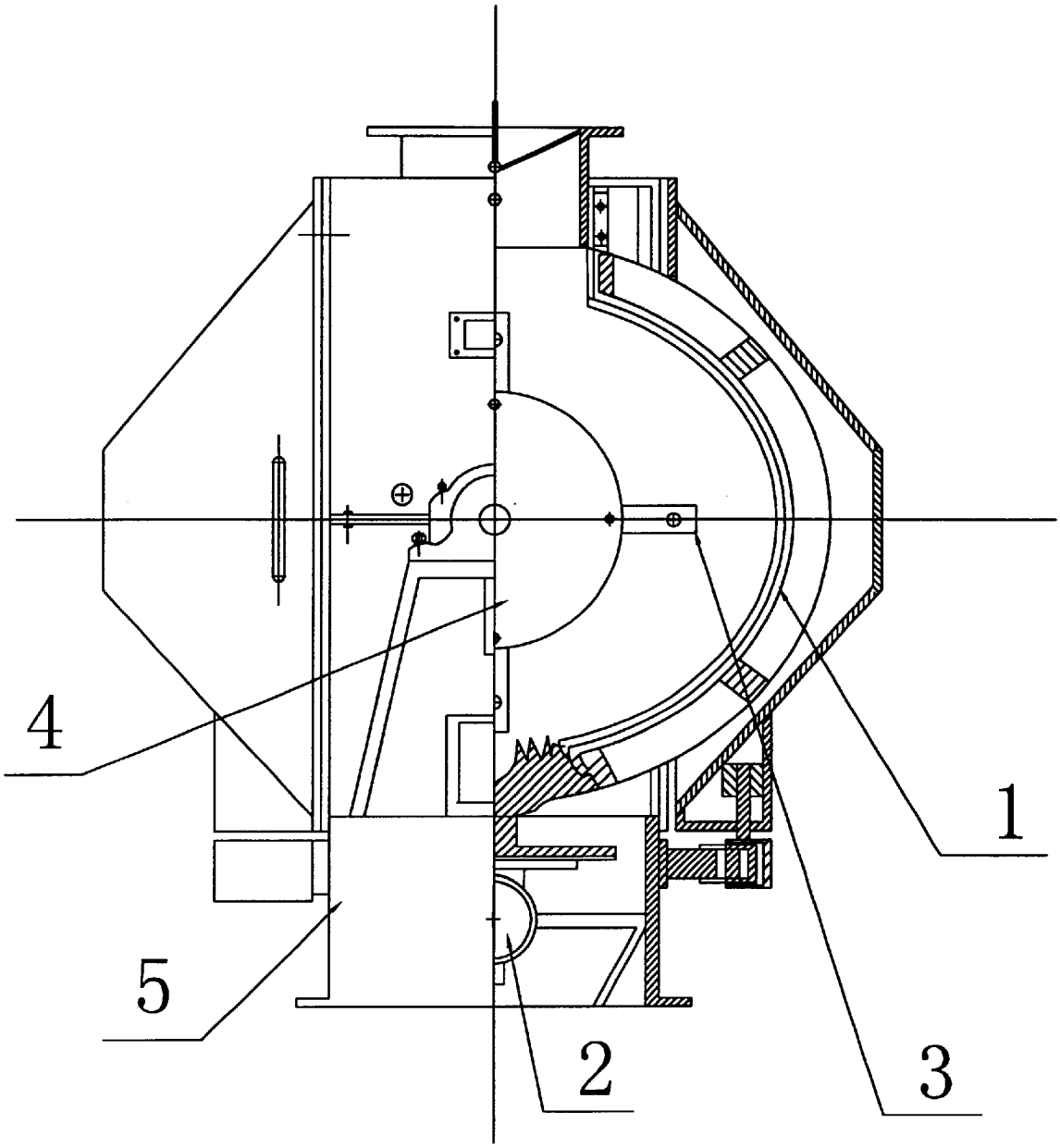
FIG. 1 shows a cross-sectional view of the hammer mill of the invention, where laterally a sub-elliptical screen is arranged on the hammer mill.
Figure 2:
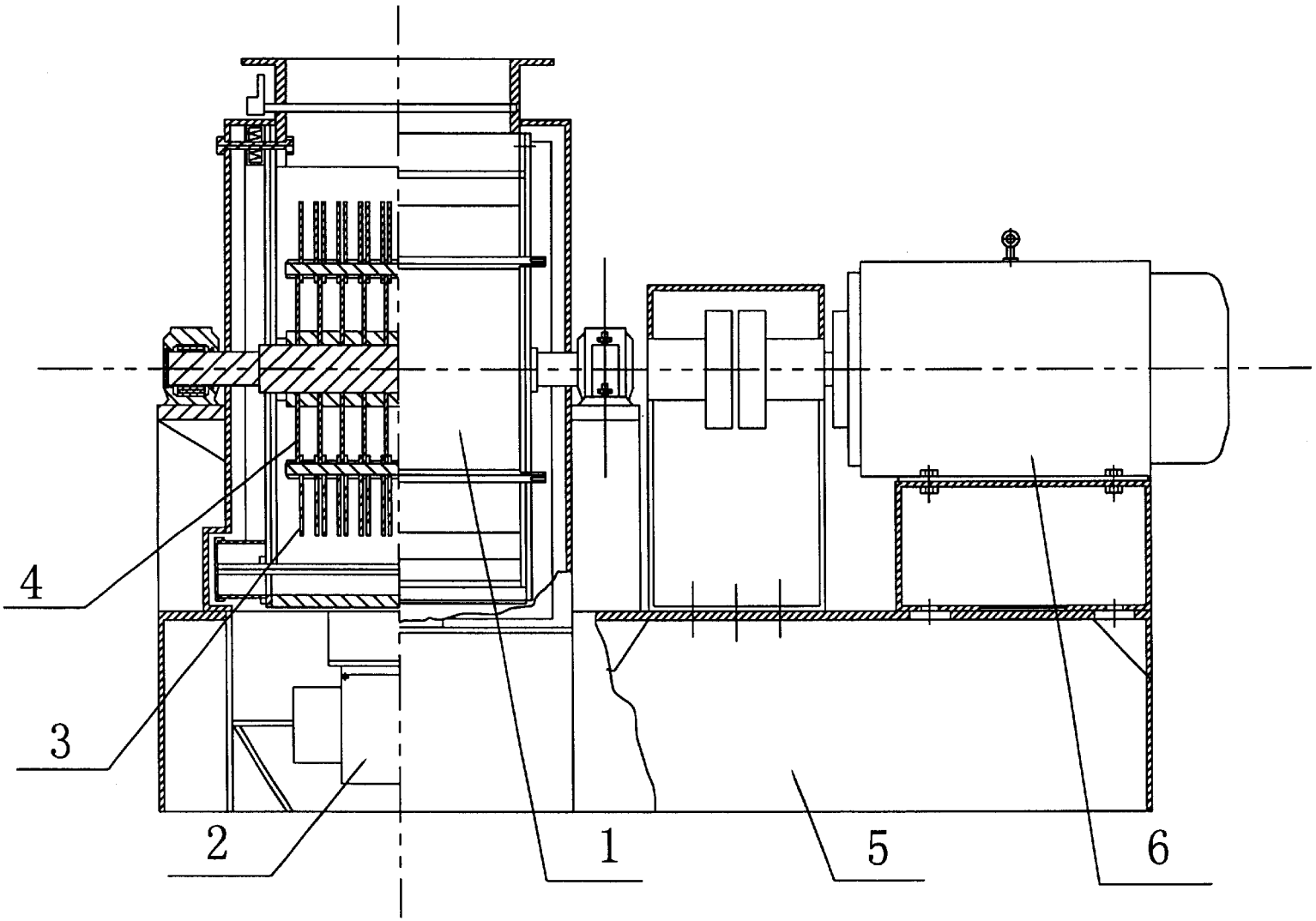
FIG. 2 shows a front view of the hammer mill of the invention.

An example of the practice of this invention is described below: As shown in FIG. 1 and FIG. 2, a type of the hammer mill consists of six components as screen assembly 1, vibrating source 2 (it is mounted onto the screen assembly 1 only), hammer blades 3, rotor 4, machine body 5 and the motor 6, of which the screen assembly is of symmetrical axis, lateral width extension screen design with an active power source.

One of the examples is the sub-elliptical screen design arranged laterally, the shape of the screen is laterally width extended and around the radial plane of the rotor the screen assembly is composed of screen plates, side plates and the screen frame. Taking Size 56×40 as an example, the lateral width is 900 mm and the height is 600 mm, and it is of symmetrical axis design at the left and the right.

The screen assembly 1 is in essence an active vibrating screen, the active vibrating source 2 is mounted onto the screen, which enables the screen assembly 1 to vibrate upward and downward as well as leftward and rightward around the radial direction of the rotor 4. Also provided is the resonance at greater amplitude. The said vibrating source adopts motor eccentric block type vibration, of which the eccentric torque is adjustable. The vibration frequency used is 50 Hz. the vibrating source 2 is mounted at the center of gravity of the screen. A vibration isolation device (e.g., spring, etc.) is provided between the screen assembly 1 and the machine body 5.

INDUSTRIAL APPLICABILITY

This invention as compared to the existing hammer mill has the following advantages: Take sub-elliptical design which is a non-standard elliptical shape as an example.

1. As shown in FIGS. 7*a*, 7*b*, 7*c* and 7*d*, the perimeters of the sub-elliptical screen is more than that of the round-shaped screen and so is the screen surface area.

2. As indicated in FIGS. 8*a*, 8*b* and FIG. 9*a* and 9*b*, the sub-elliptical screen varies the angle between normal direction the screen sieve of and the material discharge direction.

3. As indicated in FIGS. 10*a*, 10*b*, and 10*c* and FIGS. 11*a*, 11*b* and ll*c*, variation of the material flow direction gives the chance to increase the applied effective force, thus improving the efficiency.

4. The screen assembly vibrates relative to the machine body and the rotor. This enhances the discharging capability from the screen promptly. The vibration is an independent and effective factor, its application is effective even for the round-shaped screen and for the vertical hammer mill as well. The said vibration allows the screen to maintain highly the opening at the instantaneous moment so that the screened hammer mill has a fundamental change in operation and efficiency.

5. As shown in FIGS. 12*a* and 12*b*, this invention has the advantage of providing two-stage processing and the vibrating screen plays the role of combining the external vibration screen and hammer mill screen in the two-stage process flow into an entity, creating powerful screening. From this point, it is much simpler, energy-saving than the two-stage process flow, and what is more, no provision of external cycling is required.

What is claimed is:

1. A blade hammer mill adapted to produce both fine materials and course materials, the mill comprising:

a screen assembly comprising screen plates, side plates and a screen frame, the screen assembly being of symmetrical axis design, with a lateral width that is extended with an active vibrator;

hammer blades;

a rotor;

machine body;

a motor; and a vibration isolating device that isolates the active vibrator from the machine body.

2. A hammer mill as claimed in claim 1 wherein the screen plates, side plates and screen frame are incorporated around a radial plane of the rotor of the horizontal hammer mill and a maximum width from a left side of the screen frame to a right side of the screen frame against a contour of the rotor side laterally is 1.2 to 4 times of a maximum size of a vertical height of the screen frame and the screen assembly is symmetrical about a central axis.

3. A hammer mill as claimed in claim 1 wherein the vibrating source, which causes screen vibrating is only mounted onto the screen assembly, the vibrating source being suspended, allowing the screen to vibrate relative to the rotor around the radial plane of the rotor.

4. A hammer mill as claimed in claim 3 wherein a frequency of the vibrating source is between 1 and 100 Hz and an amplitude is between within 1 and 30 mm.

5. A hammer mill as claimed in claim 3 wherein the vibrating mode of the vibrating source includes all the vibrating modes as motor eccentric block vibration, electromagnetic vibration, pneumatic vibration, porcelain piezoelectric crystal vibration, and eccentric devices vibration.

6. A blade hammer mill comprising:

a screen assembly comprising screen plates, side plates and a screen frame, the screen assembly being of symmetrical axis design, with a lateral width that is extended with an active vibrator;

hammer blades;

a rotor;

machine body;

a motor; and a vibration isolating device that isolates the active vibrator from the machine body;

wherein the screen plates, side plates and screen frame are incorporated around a radial plane of the rotor of the horizontal hammer mill and a maximum width from a left side of the screen frame to a right side of the screen frame against a contour of the rotor side laterally is 1.2 to 4 times of a maximum size of a vertical height of the screen frame and the screen assembly is symmetrical about a central axis.

7. A blade hammer mill comprising:

a screen assembly comprising screen plates, side plates and a screen frame, the screen assembly being of symmetrical axis design, with a lateral width that is extended with an active vibrator;

hammer blades;

a rotor;

machine body;

a motor; and a vibration isolating device that isolates the active vibrator from the machine body;

wherein the vibrating source, which causes screen vibrating is only mounted onto the screen assembly, the vibrating source being suspended, allowing the screen to vibrate relative to the rotor around the radial plane of the rotor.

* * * * *